United States Patent [19]

Miyashita et al.

[11] Patent Number: 4,494,748

[45] Date of Patent: Jan. 22, 1985

[54] COLLATOR

[75] Inventors: Kiyoshi Miyashita; Muneo Kasuga; Akira Shimizu, all of Hachioji; Fumitaka Ozeki, Inagi; Hiroshi Tsuda, Mitaka; Katsuhiko Kimura, Hino; Nobuoto Hattori, Hachioji; Norio Amemiya, Hachioji; Masaru Yamazaki, Hachioji, all of Japan

[73] Assignee: Olympus Optical Company Limited, Tokyo, Japan

[21] Appl. No.: 335,651

[22] Filed: Dec. 30, 1981

[51] Int. Cl.[3] ..... B65H 39/02

[52] U.S. Cl. ..... 271/288; 271/297; 271/298; 271/305

[58] Field of Search ..... 271/288, 289, 297, 298, 271/305

[56] References Cited

U.S. PATENT DOCUMENTS

| | | | |
|---|---|---|---|
| 3,586,311 | 6/1971 | Schulze | 271/288 |
| 3,744,790 | 7/1973 | Hoffman . | |
| 3,937,459 | 2/1976 | Lawrence . | |
| 3,988,018 | 10/1976 | Tusso et al. . | |
| 4,015,841 | 4/1977 | Mitsumasu | 271/297 |
| 4,026,540 | 5/1977 | Lawrence | 271/297 X |
| 4,116,429 | 9/1978 | Van Buskirk | 271/297 X |
| 4,232,861 | 11/1980 | Maul | 271/288 X |

*Primary Examiner*—Richard A. Schacher

*Attorney, Agent, or Firm*—Fleit, Jacobson, Cohn & Price

[57] ABSTRACT

In a collator for use in combination with an electrophotographic copying machine which discharges copies of originals in succession at the same time interval, deflection claws for delivering successive copies of a manuscript into successive bins are provided at inlets of respective bins and two endless belts each having an actuator for driving the deflection claws are provided movably along the successive bins. The two endless belts are driven by two different controlling circuits, respectively in an independent manner. During the copy delivering operation by the first endless belt for a plurality of copies of a certain document, it is possible to initiate the copy delivering operation by the second endless belt for a plurality of copies of the next document.

11 Claims, 55 Drawing Figures

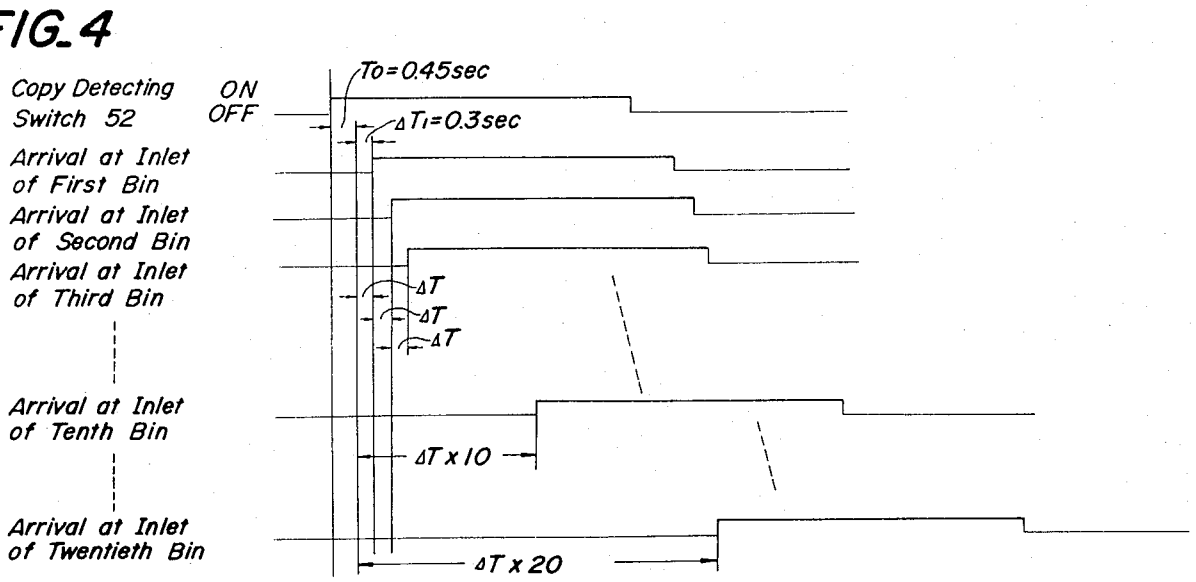
FIG. 4
Copy Detecting Switch 52
ON
OFF
Arrival at Inlet of First Bin
Arrival at Inlet of Second Bin
Arrival at Inlet of Third Bin
Arrival at Inlet of Tenth Bin
Arrival at Inlet of Twentieth Bin
To=0.45sec
ΔT1=0.3sec
ΔT
ΔT
ΔT
ΔT x 10
ΔT x 20

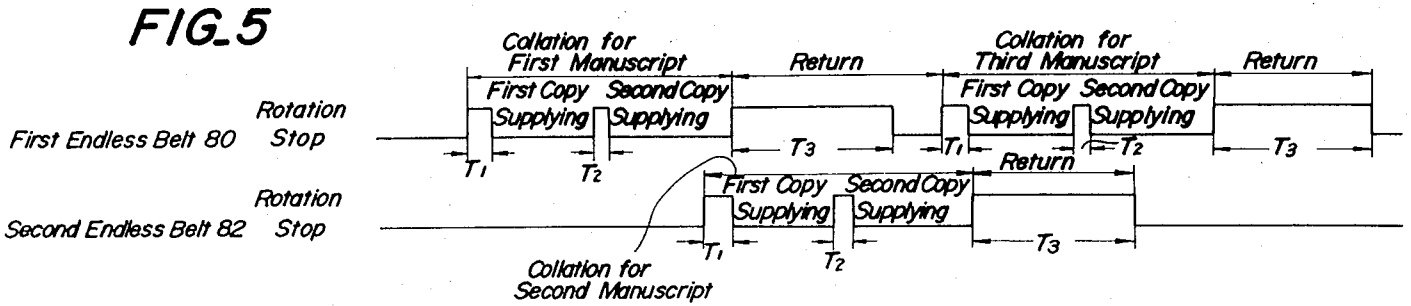
FIG. 5
First Endless Belt 80
Rotation
Stop
Second Endless Belt 82
Rotation
Stop
Collation for First Manuscript
First Copy Supplying
Second Copy Supplying
Return
Collation for Second Manuscript
First Copy Supplying
Second Copy Supplying
Return
Collation for Third Manuscript
First Copy Supplying
Second Copy Supplying
Return
T1
T2
T3

COLLATOR

BACKGROUND OF THE INVENTION

The present invention relates to a collator for use in combination with an apparatus such as a copying machine, a printing machine and the like which discharges copies of original in succession.

Such a collator is often used in combination with an electrophotographic copying machine and successive copies of an original supplied from the machine are delivered into respective bins or trays.

Such a collator can be roughly classified into three types depending on a manner of delivering the copies into the bins. In a first type, a number of bins are arranged fixedly and a distributor comprising a deflector and a copy feed mechanism is moved along a series of bins. In a second type, a series of bins are moved with respect to a copy supply position fixedly arranged in the collator. In a third type, a series of bins are fixedly arranged and at an inlet of each bin is arranged a claw like deflector. While the copies are fed along a series of bins, the deflectors of successive bins are driven to deliver the successive copies into the successive bins. The first and the third types of collator mentioned above can be comparatively small in size and could be preferably combined with a high speed copying machine. However, in the second type of collator, since the heavy bins must be driven, it could not preferably be combined with a high speed copying machine, and further requires a large space for a movement of the bins.

The present invention is to provide a collator belonging to the first and the third types of collator mentioned above. In such a collator, the distributor must be returned to an initial position after the collating operation for the last copy of a certain original has been finished, but prior to an arrival of the first copy of a next original at the collator and then the deflector at an initial position is driven. Hereinafter, said initial position is called as "home position". In Japanese Utility Model Application Publication No. 47,956/78, there is disclosed such a collator, in which a number of bins are arranged vertically one above the other, and a distributor is arranged movably from the uppermost bin to the lowermost bin so as to deliver each copies of an original into respective bins. In this collator, the distributor is returned to the home position upon actuation of a print start switch of a copying machine. Further Japanese Patent Application Publication No. 8,665/75 also discloses a similar collator in which a distributor is returned to the home position at a timing when a time period J has been elapsed after detection of the copy, said time period J being defined by $T>J>t$, wherein t is a time interval of successive copies of the same original and T is a time interval between the last copy of a certain original and the first copy of a next document. These collators can be effectively used in combination with usually available copying machines in which a single exposure of an original can form a single copy thereof and multiple copies of the original are obtained only by means of multiple exposures of the same original, and thus there is a substantial time for removing the first original from the copying machine and setting the next original, and thus said time interval T is a long.

As disclosed in Japanese Patent Laid-Open Publication No. 12,986/80 there has been developed a retention type copying machine in which a plurality of copies of an original can be obtained from the same and single electrostatic charge image once formed by subjecting it to development and transfer repeatedly. In such a copying machine of retention type, the exposure and scanning of the second document can be initiated before a completion of a duplicating operation for the first document and thus, the time interval T from the last copy of a document to the first copy of a next document can be materially shortened and, in an extreme case, can be made identical with the time interval between successive copies of the same document. In case of adopting the known collators described in the above mentioned publications Nos. 8,665/75 and 47,956/78 to the retention type copying machine, it is necessary to return the distributor to the home position during said short time interval T. However, this is very difficult. In an extreme case, if the number of copies to be formed for a document is large, the first copy of the second document might arrive at the first bin corresponding to the home position before the last copy of the first document has not yet been completely delivered to the bin.

In order to solve the above mentioned problem, for example, there have been proposed such methods that the time interval T is materially made long so as to compensate a returning time of the distributor by feeding a copy in the collator at a higher speed than in the copying machine, and that the collating operation is performed at both directions in a reciprocating manner of the distributor. However, in the former method, there occurs various technical problems due to high copy travelling speed. In the latter method, the controlling of the distributor is liable to be complex very much, and further this collator could not be used in such a case that the numbers of copies of successive originals are varied successively.

On the other hand, there have been proposed various collators which could be combined with the copying machine of retention type mentioned above. For instance, a number of bins are arranged vertically and successive copies are fed along the bins downward and are delivered into the bins from the lowermost bin. In such a collator, the distributor is returned to the lowermost bin at the home position after the last copy of a document has been completely delivered into a bin, and thus, if the returning speed of the distributor is made at least equal to the copy feeding speed, the first copy of a next document can be correctly delivered into the lowermost bin even in case that the time interval T between the last copy of a certain document and the first copy of the next document is very short. Therefore, a plurality of copies of successive documents can be collated effectively. However, in such a collator, since the home position is set at the lowermost bin and the copies are successively collated toward the upper bins, it is very inconvenient for the operator to take the collated copies out of the bins, especially when the number of copies to be formed for respective originals is relatively small. In order to avoid such a drawback, it has been also proposed to feed the copies in a direction from the lowermost bin to the uppermost bin and are successively delivered into the bins from the uppermost one. In such a collator, the operator can easily take out the collated copies, because the home position is set at the uppermost bin and copies are successive delivered downward from the uppermost bin. However, usually the copying machine has its copy outlet at a relatively upper position and thus, the collator should be provided with a copy feed mechanism for feeding the copy supplied from the copying machine to the lowermost bin. Therefore, the copy feed mechanism is liable to be large in size and complicated in construction and further since the copy has to travel along a very long and complicated path there might occur paper jamming.

SUMMARY OF THE INVENTION

The present invention has for its object to provide a simple and less expensive collator which can obviate above mentioned drawbacks and can be advantageously used in combination with an apparatus such as a retention type copying machine irrespective of a copy travelling speed.

According to the invention in a collator for use in combination with an apparatus such as a copying machine, a printing machine and the like delivering a plurality of copies successively comprises a plurality of bins arranged in parallel with each other along a copy travelling path; means for feeding the copies along the copy travelling path; means for delivering the copies fed successively along a copy travelling path into successive bins; and means for driving said delivering means so as to effect the copy delivery simultaneously at at least two different bin positions, whereby during a copy delivering operation for a plurality of copies of a certain manuscript, it is possible to initiate the copy delivering operation for a plurality of copies of the next manuscript.

BRIEF DESCRIPTION OF THE DRAWINGS

FIGS. 4 and 5 are schematic diagrams explaining one embodiment of controlling method of the collator according to the invention;

DESCRIPTION OF THE PREFERRED EMBODIMENTS

Figure 1:
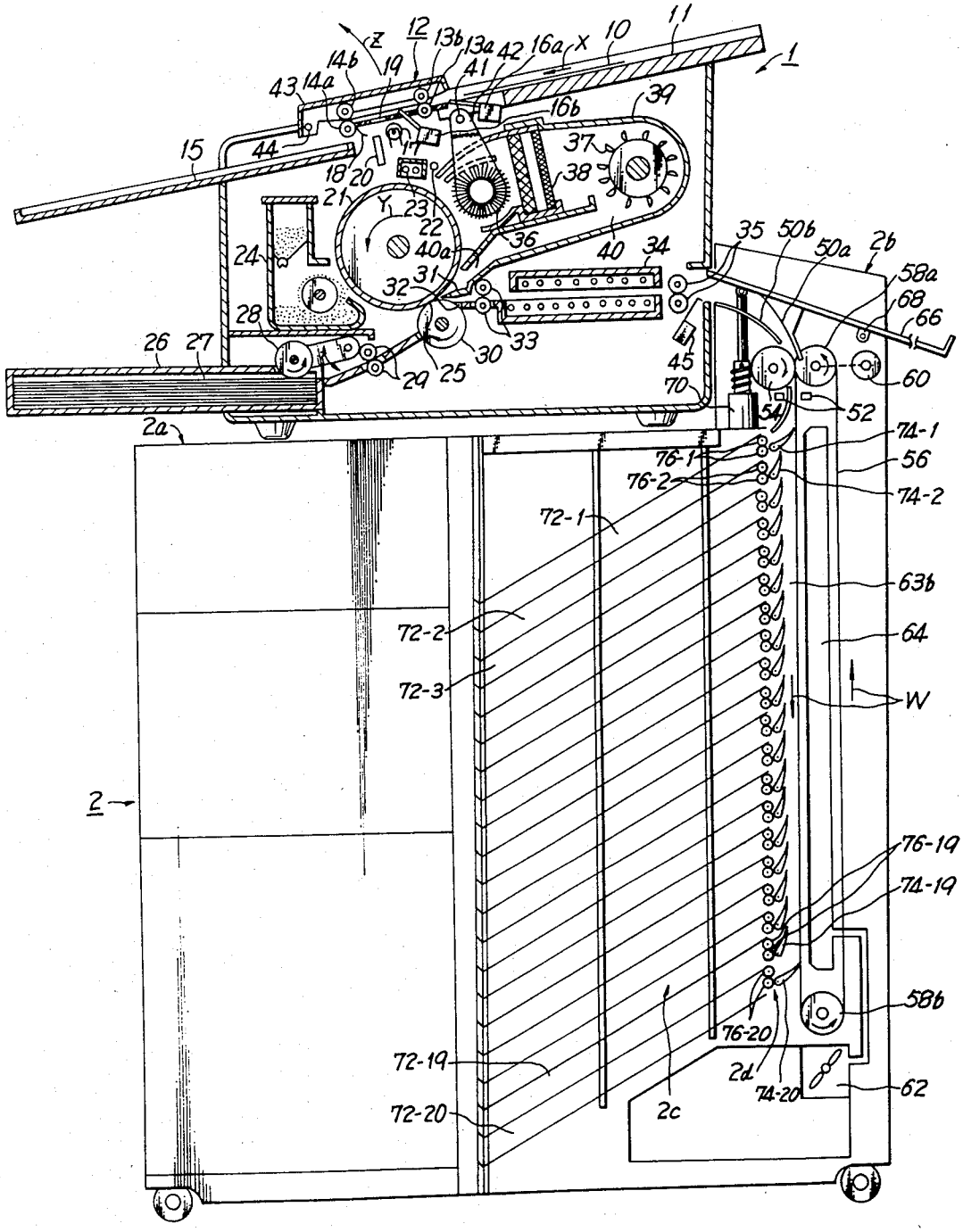
FIG. 1 is a schematic diagram showing one embodiment of a collator according to the invention for use in combination with a retention type copying machine.

FIG. 1 is a schematic diagram showing one embodiment of a collator according to the invention for use in combination with a retention type copying machine. In FIG. 1, numeral 1 generally shows a small desk type copying machine which is called as a retention type copying machine wherein multiple sheets of copies are formed by performing developing and transferring steps repeatedly with respect to an electrostatic latent image once formed on a photosensitive drum as described hereinafter. Numeral 2 shows the collator of deflector driving type according to the invention. The copying machine 1 is placed on a table portion 2*a* of the collator 2.

At first, a construction of the retention type copying machine 1 will be described in detail. The copying machine 1 is such a type that an optical system is fixedly arranged and a scanning exposure is performed by travelling a manuscript. In this copying machine 1, a sheet-like manuscript 10 is placed on a descending manuscript carriage 11 and is manually inserted into a manuscript feeding apparatus 12 from an arrow direction x. Then the manuscript is travelled by means of feed rollers 13*a*, 13*b* and 14*a*, 14*b* arranged in the manuscript feeding apparatus 12 and is finally discharged on a manuscript tray 15. The feed rollers 13*a* and 14*a* are controlled by detecting a document position by means of switches 16*a*, 16*b* arranged along a manuscript feeding path. The feed roller 13*a* is connected to a driving source not shown through a clutch also not shown, but the feed roller 14*a* is connected directly to the driving source so as to rotate always during a copying operation in which the driving source is rotated. The clutch is driven by a signal which is generated when the switch 16*a* detects, for example, a front end of the inserted manuscript 10, so that the feed roller 13*a* is rotated so as to travel the manuscript 10. Then, the clutch mentioned above is disconnected for a short time by a signal which is generated when the switch 16*b* detects the front end of manuscript 10, so that the feed roller 13*a* stops to rotate so as to cease the travelling of the manuscript 10. After elapsing said short time, the clutch is connected again at a given timing to start the travelling of the manuscript 10 again, and then disconnected after the switch 16*b* is made OFF by detecting a rear end of this manuscript 10 so that the feed roller 13*a* stops rotating. The rollers 13*b* and 14*b* are rotated cooperatively according to a rotation of the rollers 13*a* and 14*a* controlled by the aforesaid switches 16*a*, 16*b*. During a time interval in which the manuscript 10 is passed through the manuscript feeding apparatus 12, the manuscript 10 is illuminated without casting a shadow thereof by means of a fluorescent lamp 17 and a reflection mirror 18, so that a manuscript image is projected onto a rotating photosensitve drum 21 with a magnitude of unity through a transparent glass plate 19 by means of a slit projecting optical system 20 constituted by a converging optical fiber array. The photosensitive drum 21 comprises a photoconductive layer constituted of for example Se applied on a surface of electrically conductive drum and is rotated in an arrow Y direction. After removing residual electrostatic charge on the drum by a charge removing lamp 22, the photosensitive drum 21 is charged uniformly by a corona charging device 23 and then an electrostatic latent image is formed on the photoconductive layer by projecting the optical image corresponding to the manuscript image. This electrostatic latent image is developed with toners to form a visible toned image by means of a developing device 24 such as a dry two-component type magnetic brush developer, and then is transferred to a toner image transferring portion 25. at the same time, a record sheet 27 in a record sheet cassette 26 is picked up one by one by means of a pickup roller 28 which is rotatably secured to a swingable arm and is fed to the toner image transferring portion 25 by register rollers 29 at a given timing which is suitable for transferring the toned image to the record sheet 27. In the toner image transferring portion 25, the record sheet 27 is travelled between the photosensitive drum 21 and a biased transferring roller 30 to which a bias voltage is supplied. The record sheet 27 is overlaid upon the toner image on the photosensitive drum and the toner image is transferred onto the record sheet 27. At this time, since the record sheet 27 is travelled on the toner image i.e. the photosensitive drum 21 in a closely contact manner, the record sheet 27 must be peeled off by a peeling claw 31. In order to promote the peeling off operation, an air flow is additionally used as will be explained later. Then, the record sheet 27 having the toner image transferred thereon is travelled along a guide 32 into a fixing device 34 including a heater by means of feed rollers 33. After the toner image is fixed by the fixing device 34, the record sheet 27 is discharged by feed rollers 35 out of the copying machine. Since the toner image on the photosensitive drum 21 is not entirely transferred onto the record sheet 27, residual toners on the photosensitive drum 21 are removed by a rotating cleaning brush 16 and removed toners are sucked by an air flow generated by the rotation of a fan 37 and gathered by a filter 38. The cleaning brush 36 and the fan 37 are covered with a housing 39 so as to obtain a toner sucking power sufficiently and to prevent the toners from spreading in the copying machine. An exhaust of the fan 37 is introduced into a duct 40, and an outlet **40*a* of the duct 40 is opposed to the toner image transferring portion 25 to peel off the record sheet 27 effectively from the photosensitive drum 21. The cleaning brush 36 is rotatably journaled to an arm 42 which is swingable about a supporting shaft 41. An upper travelling mechanism 43 of the manuscript feeding apparatus 12 is made rotatable about a shaft 44 in a direction shown by an arrow Z. In case of copying a thick manuscript such as a book etc., the upper travelling mechanism 43 is rotated in the direction Z and is placed on the manuscript tray 15 to from a thick manuscript travelling path along which a thick manuscript travelling carriage can be fed. The various portions of the copying machine are controlled by various signals which are generated at given timings on the basis of the detection of the manuscript by means of switches 16*a*, 16*b*** arranged along the manuscript travelling path.

In the explanation mentioned above, only one sheet of copy is formed by one exposure scanning, but since the copying machine of the present embodiment is of the retention type, a plurality of copies (in this case maximum is twenty sheets) are produced by performing the developing and transferring repeatedly with respect to the electrostatic latent image once formed on the photosensitive drum 21. The number of copies can be preset by a copy number setting dial arranged on a controlling panel (not shown) of the copying machine 1. In case of carrying out the multiple copying, the cleaning brush 36 is kept away from the photosensitive drum 21. Moreover, in case of performing the multiple copying for a certain manuscript, the next manuscript can be set in a stand-by state in which a front edge of the next manuscript is introduced between the feed rollers **13*a*, 13*b*** and the exposure scanning for the next one can be started just before a completion of the copying operation for the previous one, so that a copying efficiency becomes very high.

Furthermore, a microswitch 45 for detecting a discharge of the copy is arranged near at the discharging rollers 35. Such a microswitch is arranged for detecting a paper jam of the record sheet.

Next, the collator 2 according to the invention will be explained hereinafter in detail. The collator 2 is mainly composed of a sheet receiving portion **2*b*, a bin portion 2*c*, and a deflector driving portion 2*d*. In the sheet receiving portion 2*b* are arranged guide plates 50*a*, 50*b* which change a travelling direction of the sheet-like copy discharged from the copying machine 1 almost perpendicularly downward. Near an outlet of the guide plates 50*a*, 50*b* is arranged a copy detection switch 52 which is composed of an optical sensor having a pair of light emitting and light receiving elements arranged on both sides of the copy feeding path. A feed roller 54 is arranged at the outlet of the guide plates 50*a*, 50*b* for feeding the copy in an almost vertical direction. A plurality of conveyor belts 56 are wound around a pair of rollers 58*a*, 58*b*, movably in an arrow direction W, and the roller 58*a* is rotated by a motor 60 to drive the conveyor belts 56. Inside a space formed by the conveyor belts 56, is arranged a suction box 64 connected to a suction fan 62. Since a number of suction holes are formed in the conveyor belts 56, the copy discharged from the guide plates 50*a*, 50*b* can be held on the conveyor belts 56 effectively by means of the suction fan 62 and is travelled in the manner mentioned above. Besides, in this embodiment, a copy discharging speed from the copying machine 1 is almost the same as a copy travelling speed of the conveyor belts 56. A distance between the paper discharging rollers 35 and an inlet of the copy travelling portion of the collator 2 i.e. nip points at which the travelling roller 54 is made in contact with the conveyor belts 56** is shorter than a length of the shortest copy paper.

Further in this embodiment, an upper surface of the guide plate **50*a* is formed as an extra tray 66. Therefore, this guide plate 50*a* is rotatably arranged about a shaft 68 and is coupled with a solenoid 70. When the solenoid is energized the guide plate 50*a* is rotated in a counterclockwise direction about the shaft 68. Then the copy discharged from the copying machine 1 can be discharged on the extra tray 66**.

As described above, since the copying machine 1 can form twenty sheets of copies by one exposure scanning, in the bin portion **2*c* of the collator twenty bins 72-1 to 72-20 are arranged successively at a substantially constant pitch from top to bottom. Therefore, the successive copies discharged from the guide plates 50*a*, 50*b* are travelled from top to bottom along copy inlets of successive bins by the conveyor belts 56. While the copies are fed successively from top to bottom, they are successively delivered into successive bins by means of claw-like deflectors 74-1 to 74-20 each of which is arranged at the copy inlet of respective bins to selectively intrude into the copy travelling path. In FIG. 1, only one deflector is shown for respective bins, but actually a few deflectors are arranged coaxially in a perpendicular direction with respect to a plane of the drawing and movably between successive conveyor belts 56. Moreover, in this embodiment, in order to travel and supply the copy guided by respective deflectors effectively into respective bins, a pair of feed rollers 76-1 to 76-20** are arranged at the copy inlet of respective bins.

Figure 2:
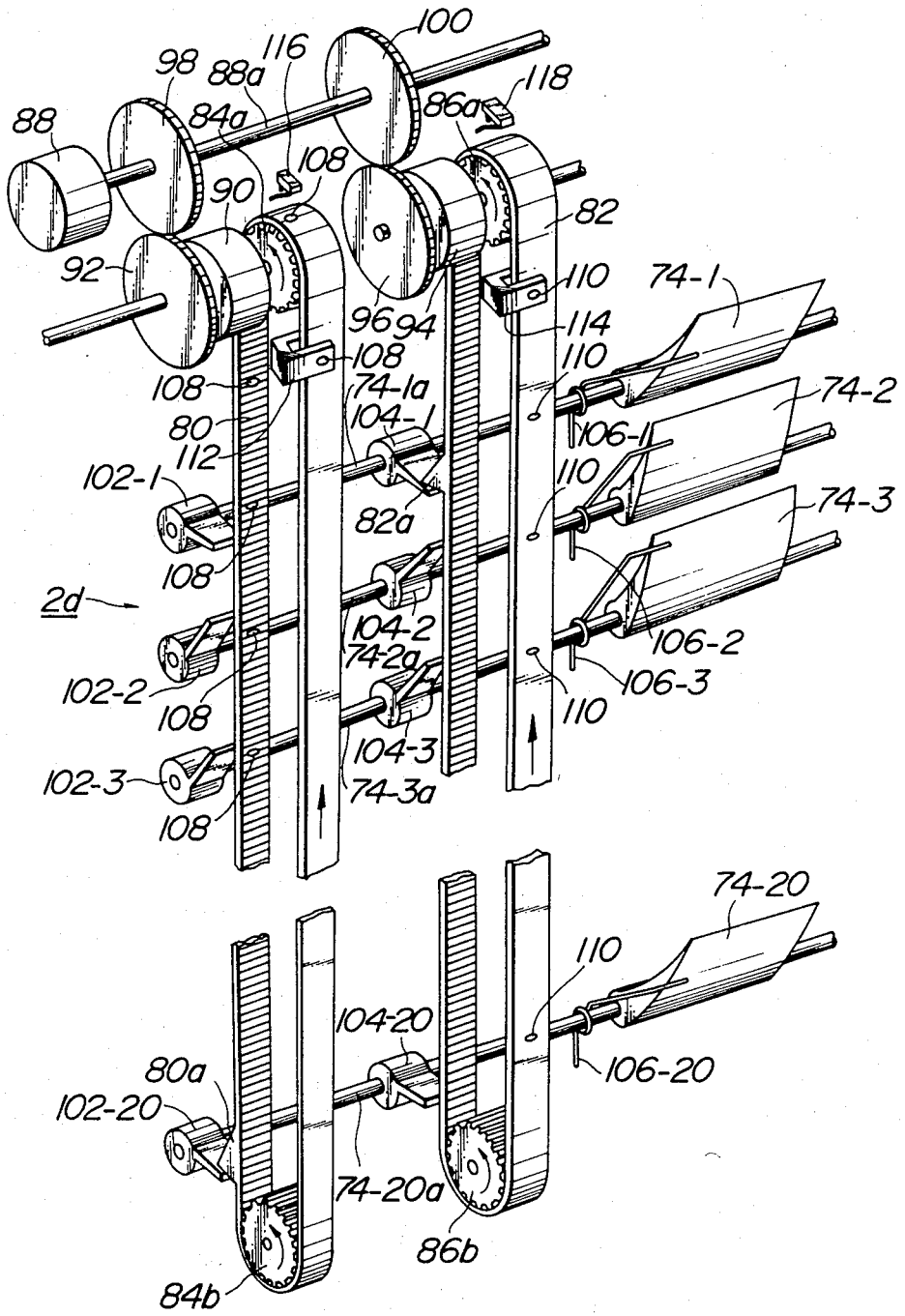
FIG. 2 is a perspective view illustrating one embodiment of a deflector driving portion of the collator shown in FIG. 1.

FIG. 2 is a perspective view illustrating one embodiment of the deflector driving portion 2*d* in the collator shown in FIG. 1. In FIG. 2, successive deflectors 74-1 to 74-20 are driven independently by means of a first and a second endless belts 80 and 82. The first and the second endless belts 80 and 82 are wound around pairs of rollers 84*a*, 84*b* and 86*a*, 86*b*, respectively rotatably in a direction shown by an arrow in parallel with the copy travelling path. In this embodiment, these two endless belts 80 and 82 are rotated independently by a single driving motor 88. Therefore, an electromagnetic clutch 90 and a gear 92 are arranged coaxially with the roller 84*a* and also an electromagnetic clutch 94 and a gear 96 are provided coaxially with the roller 86*a*. These gears 92 and 96 are engaged with gears 98 and 100, respectively which are secured to an output shaft 88*a* of the driving motor 88. On two endless belts 80 and 82 are arranged projection-like actuator chips 80*a*, 82*a* for intruding the deflectors 74-1 to 74-20 successively into the copy travelling path by driving these deflectors successively according to a rotation of the endless belts.

To shafts 74-1*a* to 74-20*a* of respective deflectors 74-1 to 74-20 are arranged a pair of driving chips 102-1; 104-1 to 102-20; 104-20 which can be engaged with the actuator chips 80*a* and 82*a* on the endless belts 80 and 82, respectively. Further returning springs 106-1 to 106-20 are provided about respective shafts 74-1*a* to 74-20*a* for removing the deflectors from the copy travelling path. In a state shown in FIG. 2, the actuator chip 80*a* of the first endless belt 80 is engaged with the driving chip 102-20 of the lowermost deflector 74-20, and the actuator chip 82*a* of the second endless belt 82 is engaged with the driving chip 104-1 of the uppermost deflector 74-1, so that the deflectors 74-1 and 74-20 are intruded into the copy travelling path at the same time.

In each of the first and the second endless belts 80 and 82 are also formed twenty pitch holes 108 and 110 with respect to the position of respective bins in order to detect the positions of actuator chips 80*a* and 82*a* corresponding to the deflectors 74-1 to 74-20 i.e. the bins 72-1 to 72-20, and these pitch holes are detected by means of photosensors 112 and 114, respectively having light emitting and light receiving elements fixedly arranged on both sides of the respective endless belts 80 and 82.

In this embodiment, it is assumed that a home position of the first and the second endless belts 80 and 82 is such a state that the actuator chips 80*a* and 82*a* of two endless belts 80 and 82 are positioned at an uppermost position of the rollers 84*a* and 86*a*. Microswitches 116 and 118 are arranged near the rollers 84*a* and 86*a*, respectively to be driven by the actuator chips 80*a* and 82*a*, respectively to detect the chips 80*a*, 80*b* in the home position.

Now, an operation of the collator according to the invention will be described hereinafter. The copying machine 1 for use in combination with the collator 2 according to the invention is the retention type one wherein twenty sheets of copies can be produced from the same and single electrostatic charge image of a manuscript. In this embodiment, a circumferencial length of the photosensitive drum 21 in the copying machine 1 is 400 mm, and one sheet of copy is formed by one rotation of the drum. Furthermore, a copying speed of the copying machine 1 is ten sheets of copies per minute, and a feeding period T of the successive copies is six seconds. Therefore, a copy travelling speed of the copying machine 1 becomes 400 mm/6 seconds=66.7 mm/sec. Moreover, a size of usable maximum copy is a legal size having a length of 355 mm. Therefore, a time interval t of the successive copies, i.e. a time interval corresponding to a length between the rear edge of a copy and the front edge of a next copy is (400-355)/66.7=0.675 sec. Further, a time interval corresponding to a length between a rear edge of the last copy of a certain manuscript and a front edge of the first copy of a next manuscript is the same as the time interval t=0.675 sec. mentioned above. Therefore, in the multiple copying mode, the successive copies are supplied from the copying machine 1 at the period T=6 sec. with the time interval t=0.675 sec. In the collator, the copy is travelled at the same speed of 66.7 mm/sec. as the copy travelling speed in the copying machine 1.

Figure 3A:
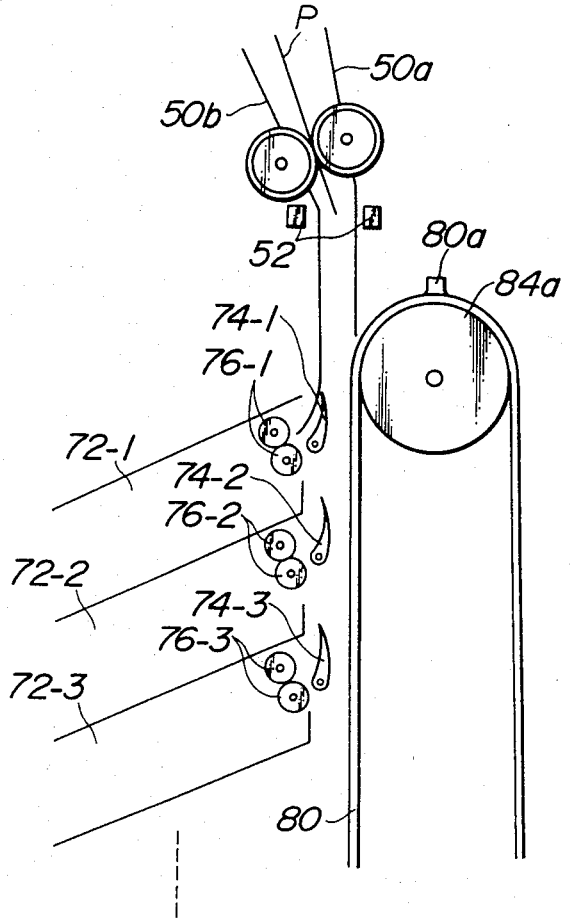
FIGS. 3A and 3B are schematic diagrams depicting a relation between a copy arrival time at respective bins of the collator and a rotation of endless belt.
Figure 3B:
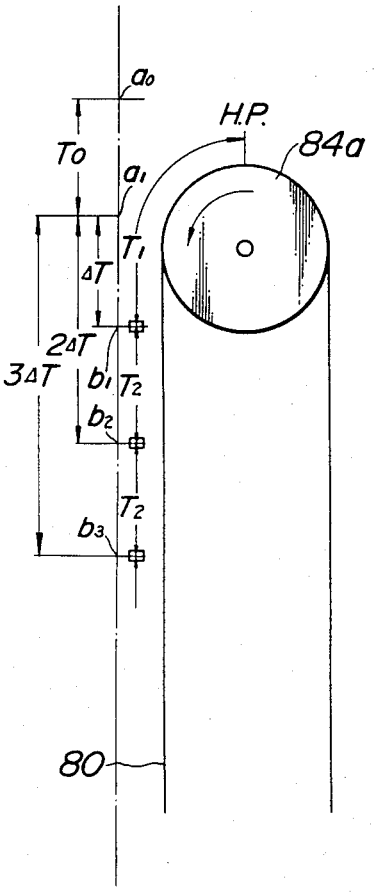

At first, a relation between the rotation phase of the endless belt 80 and timings at which the copy arrived at the respective bins will be explained with reference to FIGS. 3A, 3B, and 4. In this embodiment, since two endless belts 80 and 82 having the same construction are driven and controlled independently, only one driving mechanism having the first endless belt 80 is shown in FIGS. 3A and 3B. In FIG. 3B, $a_0$ shows a copy detecting position by means of the switch 52, and $b_1$, $b_2$, $b_3$, . . . show inlet positions of the copy for the first, the second, the third, . . . bins, that is, stop positions of the actuating chip 80*a* of the endless belt 80. In this embodiment, the pitch of the respective bins 72-1 to 72-20 is about 20 mm and a distance from the position $a_0$ to the position $b_1$ is about 50 mm. It is further defined a position $a_1$ which is apart by about 20 mm to an upstream side of the copy travelling path from the copy inlet position $b_1$ of the first bin 72-1. Since the travelling speed of the copy P is 66.7 mm/sec. as mentioned above, a travelling time $T_0$ from the position $a_0$ to the position $a_1$ is about 0.44 sec. for a distance from $a_0$ to $a_1$ is about 30 mm, and a travelling time $\Delta T$ from the position $a_1$ to the position $b_1$ as well as from the copy inlet position for a certain bin to the position for the next one is about 0.3 sec. for a distance from $a_1$ to $b_1$ is about 20 mm. Therefore, a time interval from a time when the copy P passes through the copy detecting switch 52 to a time when the copy P arrives at the copy inlet positions $b_1$, $b_2$, $b_3$ . . . of the successive bins 72-1 to 72-20 becomes $T_0+\Delta T$ (n=1, 2, . . . 20) as illustrated in FIG. 4. In this manner, it is possible to make a controlling circuit described later much simple by introducing the imaginary position $a_1$ which is apart from the position $b_1$ of the first bin 72-1 by the distance of bin pitch to an upstream side.

In the stand-by state, the endless belt 80 is set at the home position H.P. wherein the actuator chip 80*a* thereon is located in the uppermost position of the roller 84*a*. Then, during a time interval $T_0+\Delta T$ from a time instant when the first copy of a certain manuscript passes through the copy detecting switch 52 to a time when the copy arrives at the copy inlet position $b_1$ of the first bin 72-1, the actuator chip 80*a* is travelled from the home position H.P. to the position $b_1$ and stopped for a given time interval at this position so as to drive the driving chip 102-1 (see FIG. 2), so that the deflector 74-1 is projected into the copy travelling path. In this embodiment, a travelling distance from the home position H.P. to the position $b_1$ is about 50 mm and a rotating speed of the belt is 130 mm/sec. which is about two times as much as the copy travelling speed. Therefore, a travelling time $T_1$ from the home position H.P. to the position $b_1$ becomes about 0.38 sec. and also a travelling time $T_2$ from a certain bin to the next one becomes 0.15 sec. The endless belt 80 is again rotated at such a timing that the first copy is supplied completely into the first bin 72-1, and is stopped again to drive the deflector 74-2 of the second bin 72-2. After that, the belt is rotated and stopped repeatedly in the same manner mentioned above and is finally returned to the home position after finishing the collation of desired number of sheets for a certain manuscript.

FIG. 5 is a time chart illustrating an operation of two endless belts 80 and 82 in case of collating two sheets of copies corresponding to each of three manuscripts, respectively. Two sheets of copies of the first manuscript are supplied into the first bin 72-1 and the second bin 72-2, respectively by means of the deflectors 74-1 and 74-2 driven successively by the actuator chip 80*a* of first belt 80. Two sheets of copies of the second manuscript are supplied into the first and the second bins 72-1 and 72-2, respectively by means of the deflectors 74-1 and 74-2 driven successively by the actuator chip 82*a* of second endless belt 82 and for the two copies of the third manuscript the collating operation is performed by the first endless belt 80. In this manner, according to the invention, the copies of an odd number manuscript such as first, third, fifth, . . . are collated by the first endless belt 80 and the copies of an even number manuscript such as second, fourth, sixth, . . . are collated by the second endless belt 82. Besides, in FIG. 5 is shown a time $T_3$ during which the belts 80, 82 return to the home position after finishing the collation. This time $T_3$ is different according to the number of sheets to be collated and the maximum time interval is required in case of collating two sheets of the copies. In this case, if a circumference length of the belt is about 1000 mm and a travelling distance from the home position H.P. to the copy inlet position $b_2$ (see FIG. 3B) of the second bin 72-2 is 70 mm, the time $T_3$ mentioned above becomes about 7.2 sec.

Figure 6:
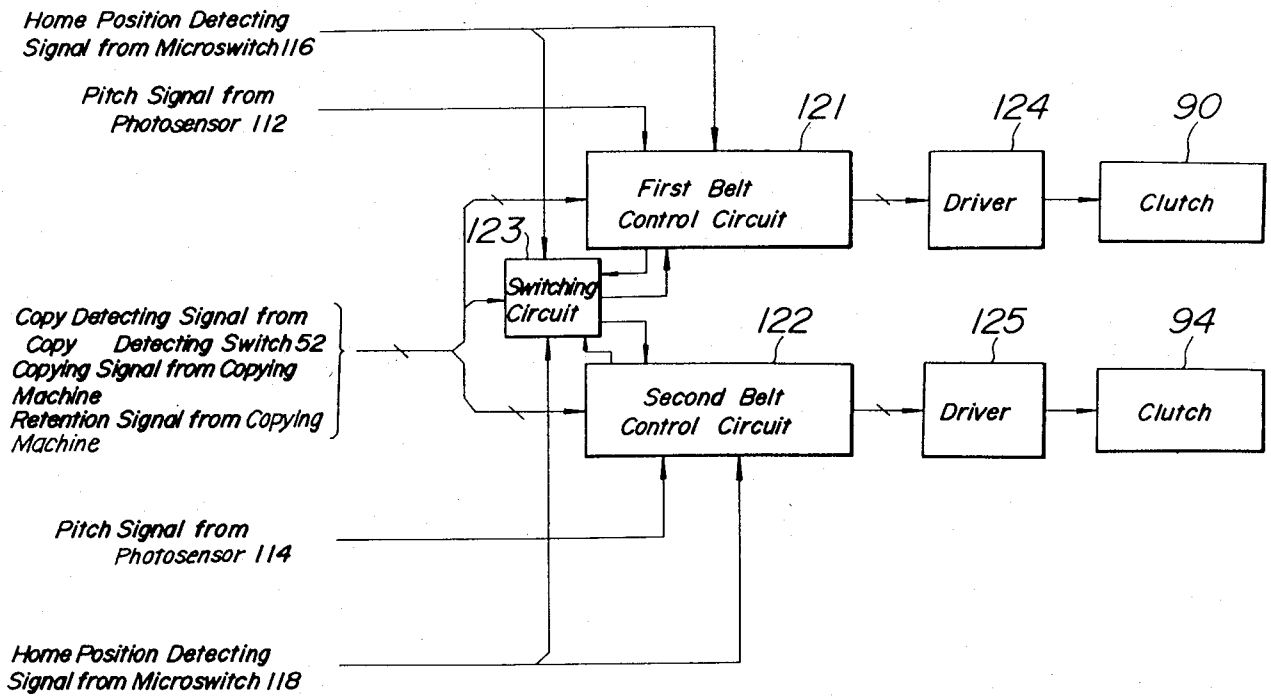
FIG. 6 is a block diagram illustrating one embodiment of a collator controlling unit.

FIG. 6 is a block diagram illustrating one embodiment of a collator controlling unit. In the collator according to the invention, the first and the second endless belts 80 and 82 are driven independently through the clutches 90 and 94 by means of one driving motor 88. To this end, there are provided a first endless belt controlling circuit 121 and a second endless belt controlling circuit 122 controlled by a switching circuit 123. Moreover, the clutch 90 is selectively energized through a driver 124 by the first endless belt controlling circuit 121 and also the clutch 94 is selectively energized through a driver 125 by the second endless belt controlling circuit 122. In order to perform such a controlling, a home position detection signal from the microswitch 116 (see FIG. 2), a pitch signal from the photosensor 112 (see FIG. 2), and a copy detection signal from the copy detecting switch 52 are supplied to the first endless belt controlling circuit 121. In the same way, a home position detection signal from the microswitch 118 (see FIG. 2), a pitch signal from the photosensor 114 (see FIG. 2), and the copy detection signal from the copy detecting switch 52 are supplied to the second endless belt controlling circuit 122. Moreover, the copy detection signal from the copy detecting switch 52, the home position detection signals from the microswitches 116, 118, and further a copying signal and a retention signal produced from a driving control portion of the copying machine 1 are supplied to the switching circuit 123.

Hereinafter, circuit constructions of the first and the second endless belt controlling circuits 121 and 122 and a circuit construction of the switching circuit 123 will be explained.

Figure 7:
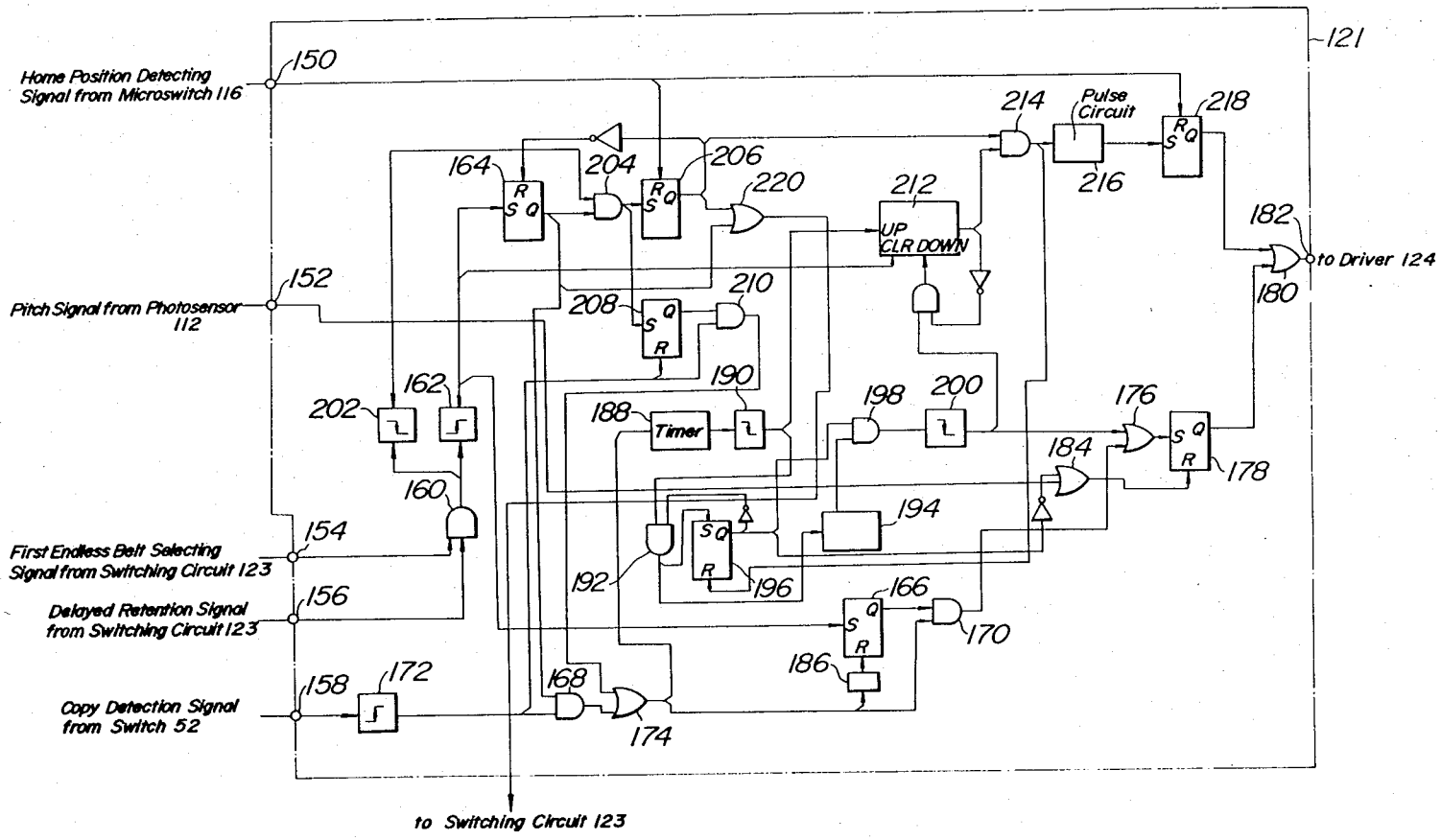
FIG. 7 is a circuit diagram illustrating one embodiment of first endless belt controlling circuit shown in FIG. 6.

FIG. 7 is a circuit diagram showing one embodiment of the first endless belt controlling circuit 121. In FIG. 7, the home position detection signal shown in FIG. 8L from the microswitch 116 is supplied to an input terminal 150. The home position detection signal mentioned above shows that the first endless belt 80 is located at the home position when this detecting signal is in H level. The pitch signal shown in FIG. 8I from the photosensor 112 is supplied to an input terminal 152. This pitch signal becomes H level when the pitch holes 108 are detected by the photosensor 112. A first endless belt selecting signal, as described later, from the switching circuit 123 is supplied to an input terminal 154. When the selecting signal is in H level, the first controlling circuit 121 is selected to drive the first endless belt 80. The delayed retention signal shown in FIG. 8F from the switching circuit 123 is supplied to an input terminal 156. The copy detection signal shown in FIG. 8E from the copy detecting switch 52 is supplied to an input terminal 158. The copy detection signal becomes H level during such an interval that the copy is passing through the position of the switch 52.

Figures 8A, 8B, 8C, 8D, 8E, 8F, 8G, 8H, 8I, 8J, 8K, 8L, 8M, 8N, 8O, 8P, 8Q, 8R:
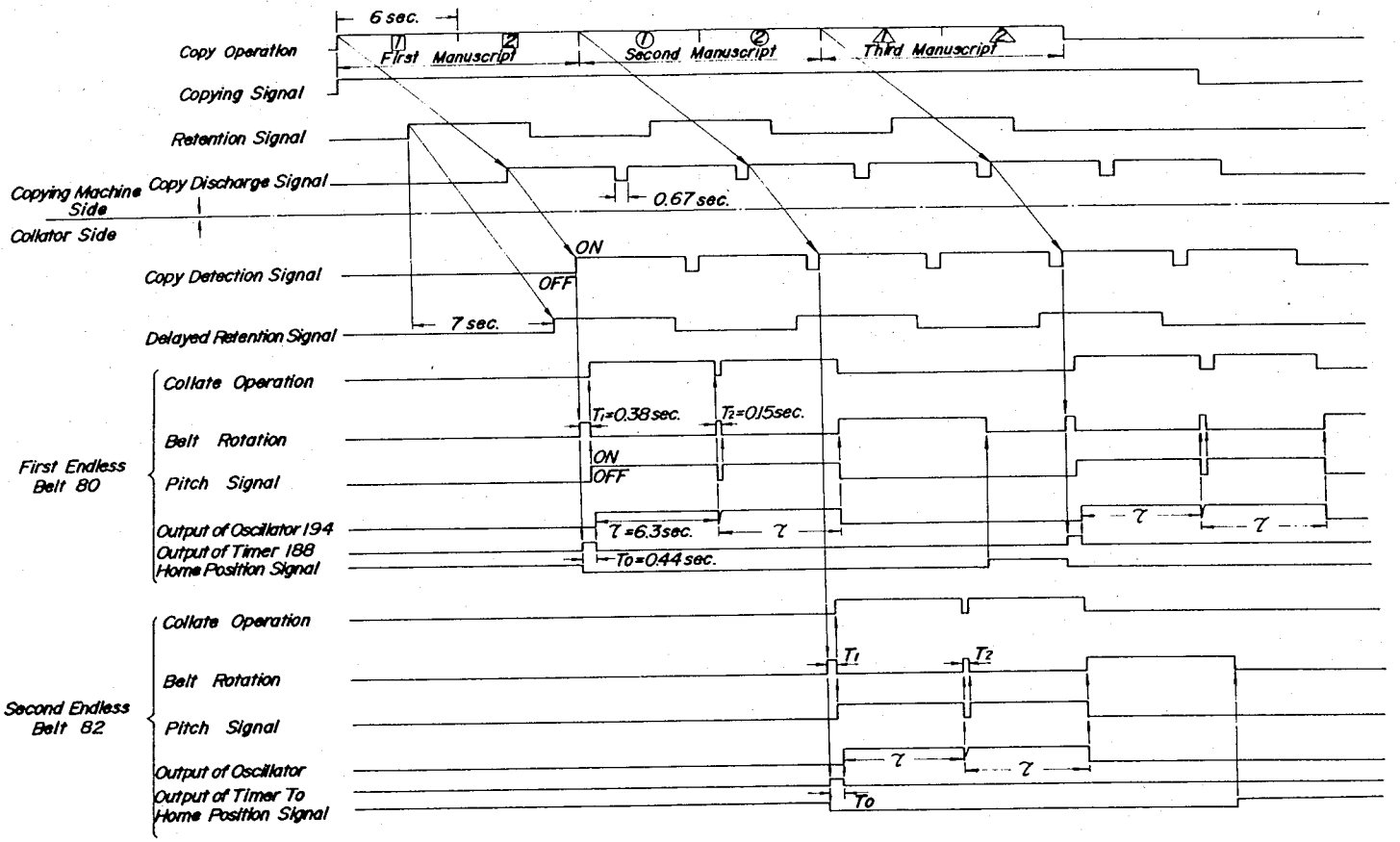
FIGS. 8A to 8R are signal waveforms explaining respective operations of the collator controlling unit shown in FIG. 6.

Now, a construction and an operation of the first endless belt controlling circuit 121 shown in FIG. 7 will be described hereinafter with reference to signal waveforms illustrated in FIG. 8 in case of collating two sheets of copies of each of three manuscripts of legal size. The retention signal illustrated in FIG. 8C becomes H level in an operation for the first copy of respective manuscripts and becomes L level in an operation for the second copy of respective manuscripts illustrated in FIG. 8A. Moreover, a copy discharge signal supplied from the microswitch 45 for detecting a copy discharge of the copying machine 1 illustrated in FIG. 1 becomes H level as depicted in FIG. 8D substantially at a middle of a duplicating operation for forming the second copy of a certain manuscript starts, and then becomes L level in a duplicating operation for the first copy of the next manuscript. Furthermore, the copy detection signal shown in FIG. 8E is produced from the copy detecting switch 52 of the collator 2 substantially at the same timing when the duplication of the first copy of the next manuscript starts.

In the circuit construction of the present embodiment, various flip flops (hereinafter abbreviated as FF) are initially reset when a power supply is switched on and a copy operation of non-collate mode is usually performed.

Contrary to this, when a collate mode is selected, the first endless belt 80 is first selected, and the signal supplied to the input terminal 154 becomes H level. Then the delayed retention signal supplied to the input terminal 156 passes through an AND gate 160 and a pulse is generated at a raising edge of the delayed retention signal by a pulse circuit 162. Therefore, FFs 164 and 166 are set at the same time by the pulse thus produced and AND gates 168 and 170 which are connected to Q output terminals of FFs 164 and 166, respectively are made enabled. When the first copy of the first manuscript is detected by the microswitch 52, a pulse is generated at a raising edge of the delayed retention signal by a pulse circuit 172. This pulse passes through AND gate 168, OR gate 174, AND gate 170, and OR gate 176, and then sets FF 178. The FF 178 is used for driving the first belt 80 in a stepwise manner and supplies at its Q output a H level signal which is then supplied to an output terminal 182 through OR gate 180, to rotate the first endless belt 80 by connecting the clutch 90 (see FIG. 8H).

When the endless belt 80 is rotated and the deflector 74-1 of the first bin 72-1 is driven, the pitch signal supplied from the input terminal 152 becomes H level so that this signal resets FF 178 through OR gate 184 and stops a rotation of the belt 80 by turning off the clutch 90. Since FF 166 is reset by the output signal from OR gate 174 delayed by a delay circuit 186 after detecting the first copy, no pulse corresponding to the front edge of the copy detecting signal can pass through AND gate 70 after that. The copy detecting pulse generated from the pulse circuit 172 triggers a timer 188 through AND gate 168 and OR gate 174 to produce an output pulse. The output pulse from timer 188 is ceased after a lapse of time $T_0=0.44$ sec. as shown in FIG. 8K. A pulse is generated from a pulse circuit 190 at a trailing edge of the pulse from the timer 188, i.e. at a transient from H level to L level, and then an oscillator 194 is set initially through AND gate 192 by the pulse. The oscillator 194 operates at a period of $\pi=6+\Delta T=6.3$ sec. as shown in FIG. 8J. At the same time, FF 196 is set and AND gate 198 is made enabled by Q output of FF 196 so as to pass an output signal of the oscillator 194. Then, a pulse generated from a pulse circuit 200 at a trailing edge of an output of the oscillator 194 sets FF 178 through OR gate 176 and connects the clutch 90 again so as to start a rotation of the first belt 80 so that the belt 80 proceeds to the next bin 72-2 and is stopped again by the pitch signal. In this manner, the first belt 80 is rotated at one step per 6.3 sec. by receiving a signal supplied from the oscillator 194. A time interval $T_2$ required for the rotation of one step is 0.15 sec. as described above.

Since the retention signal becomes L level before an end of the copy of the first manuscript, the end of collating operation by the first belt 80 is determined by observing this retention signal. That is to say, FF 206 and FF 208 are set respectively through AND gate 204 by a pulse generated from a pulse circuit 202 at the trailing edge of the delayed retention signal. FF 208 is reset by the next pulse supplied from the pulse circuit 172, but this pulse passes through AND gate 210. That is to say, the first copy detection signal after the trailing edge of the retention signal is accepted and the relevant copy is recognized to belong to the first manuscript. The second copy i.e. the front pulse of the last copy triggers the timer 188 through AND gate 210 and OR gate 174, and the pulse circuit 190 generates a pulse at a time-up point of the timer 188 and this pulse is supplied to a count-up terminal of a counter 212. This counter 212 counts up $T_0$ sec. later after the detection of copy and then counts down by an output supplied from the pulse circuit 200 for rotating the belt 80 one step period $\tau=6.3$ sec. later after the counting up. Therefore, this counter 212 counts up the number of copies to be fed and counts down by the number of steps of the belt, so that after the collating operation is completely finished, the content of counter 212 becomes "0". The collating operation described above is illustrated in FIG. 8G and each copy is supplied completely into a desired bin during an interval in which the signal showing the collating operation is in H level.

When Q output of FF 206 and an output of the counter 212 become H level respectively, FF 218 is set by a pulse generated from a pulse circuit 216 through AND gate 214 and Q output of FF 218 is supplied to an output terminal 182 through OR gate 180 to return the belt 80 to the home position. If the belt 80 is rotated to the home position, the home position signal from the microswitch 116 is supplied to the input terminal 150, so that FF 218 is reset and the belt 80 is stopped at the home position. During the collating operation explained above, Q outputs of FF 164 and FF 206 are supplied to the switching circuit 123 to be described later through OR gate 220 for indicating that the first endless belt 80 is used in the related collating operation.

Hereinbefore, the construction and operation of the first endless belt controlling circuit 121 have been explained, but the second endless belt controlling circuit 122 has the same construction and operation as those mentioned above. Collating operation signal, pitch signal, output of the oscillator, output of the timer $T_0$, and home position signal are illustrated in FIGS. 8M to 8R.

Figure 9:
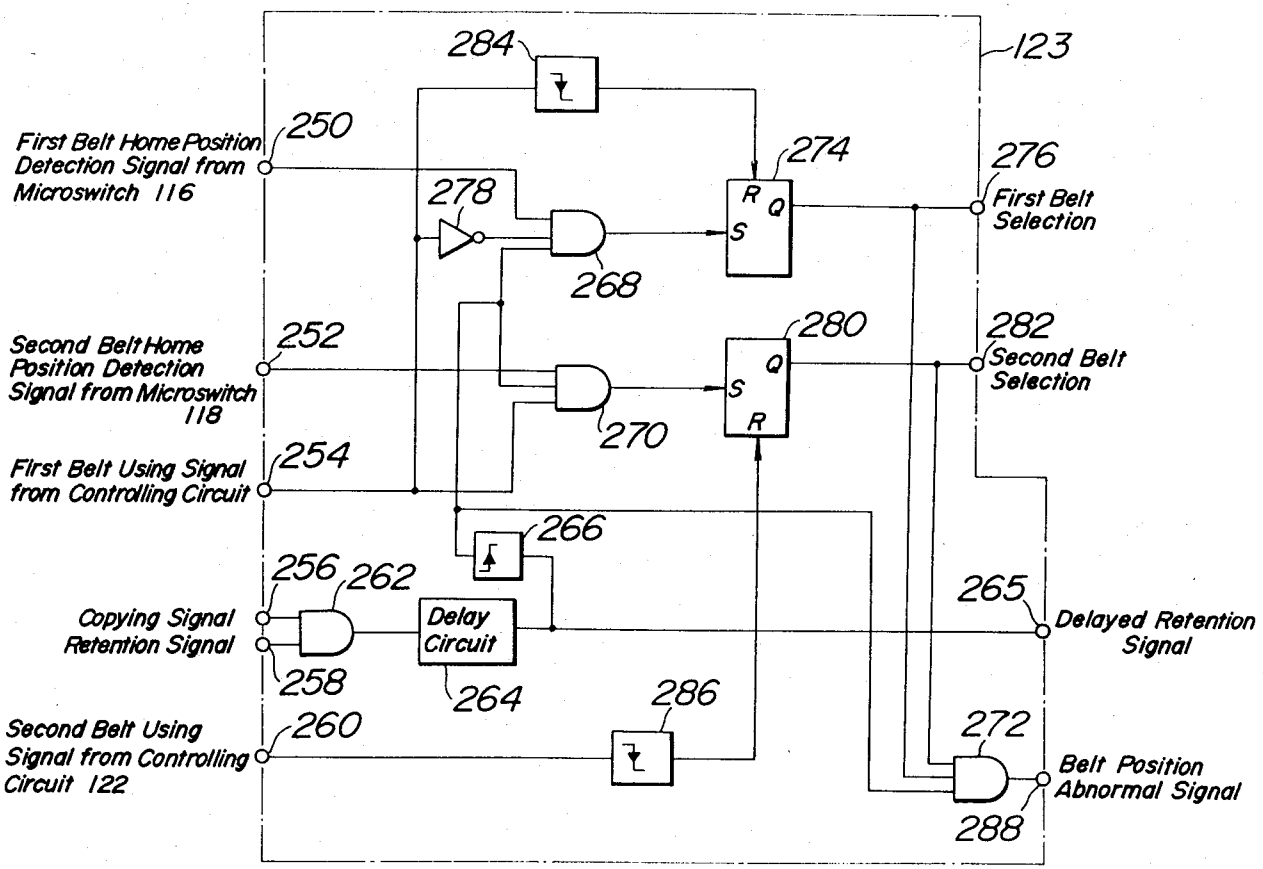
FIG. 9 is a circuit diagram showing one embodiment of a switching circuit in the collator controlling unit shown in FIG. 6.

FIG. 9 is a circuit diagram showing one embodiment of the switching circuit 123. In FIG. 9, the home position detection signal of the first belt generated from the microswitch 116 is supplied to an input terminal 250 and also the home position detection signal of the second belt generated from the microswitch 118 is supplied to an input terminal 252. Moreover, a first belt using signal and a second belt using signal are supplied to input terminals 254 and 260, respectively. Then, to input terminals 256 and 258 are supplied the copying signal and the retention signal illustrated in FIGS. 8B and 8C, respectively which are supplied from the driving control portion of the copying machine 1. These copying signal and retention signal are supplied to AND gate 262 so as to delay the retention signal for seven seconds by a delay circuit 264 as shown in FIG. 8F, and then the delayed retention signal is supplied to the controlling circuits 121 and 122 through an output terminal 265. Furthermore, a pulse generated from a pulse circuit 266 at the leading edge of the delayed signal is supplied to AND gates 268, 270 and 272. In this time, if the first belt 80 is located at the home position, FF 274 is set and an output signal of FF 274 is supplied to an output terminal 276 as a first belt selecting signal. In case that the first belt is in use, since AND gate 268 is closed by an output of an inverter 278, FF 274 is not set. In this case, as AND gate 270 is opened, FF 280 is set and an output signal of FF 280 is supplied to an output terminal 282 as the second belt selecting signal. This signal is also supplied to the controlling circuit. FFs 274 and 280 are reset respectively by pulses generated from pulse circuits 284, 286 at a trailing edge of the belt using signal, since each belt using signals changes from H level to L level after completion of the collation using respective belts.

Moreover, a failure of the belt operation is detected by AND gate 272 to which an output of FFs 274, 280 are supplied, and then the detected signal is supplied to an output terminal 288 so as to indicate the failure, raise an alarm, and switch off the power supply. That is to say, as clearly understood from the above explanation, in the normal operation, when the retention signal is supplied, at least one belt is located in the home position and one of outputs of FFs 274, 280 becomes L level so that an output of AND gate 272 becomes L level. However, if the belt does not rotate or the microswitches for detecting the home position are out of order, when the delayed retention signal is supplied, an output of AND gate 272 becomes H level to indicate that the belt operation is not carried out normally.

Figures 10A, 10B, 10C, 10D, 10E, 10F, 10G, 10H:
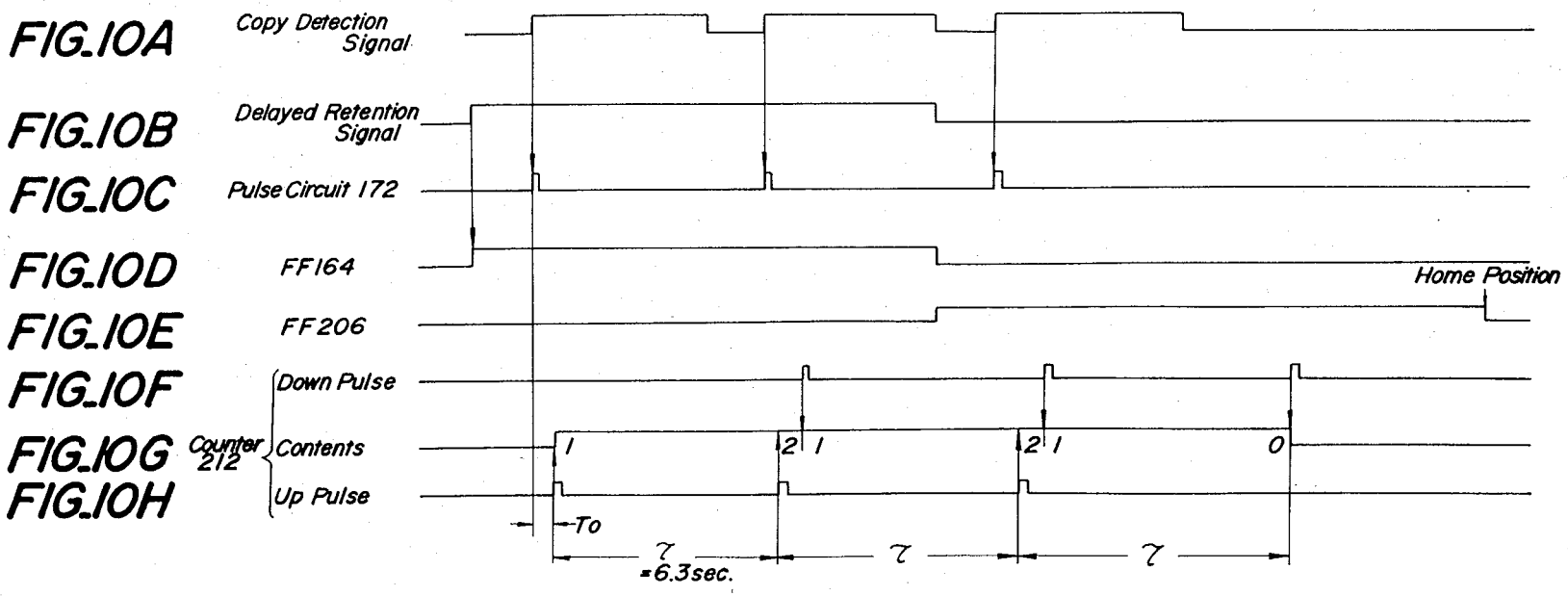
FIGS. 10A to 10H are signal waveforms explaining detailed operations of the first endless belt controlling circuit shown in FIG. 7.

FIGS. 10A to 10H are signal waveforms explaining detailed operations of the first endless belt controlling circuit 121 shown in FIG. 7 in case of collating three sheets of copies for respective manuscript. FIG. 10A is a signal waveform showing the copy detection signal produced by the copy detecting switch 52, and FIG. 10B is a signal waveform illustrating the delayed retention signal supplied from the switching circuit 123. FIG. 10C is a signal waveform showing an output signal of a pulse generated from the pulse circuit 172 at the raising edge of the copy detecting signal. FIGS. 10D and 10E are signal waveforms showing respective Q output signals of FFs 164 and 206. FIGS. 10F and 10H are signal waveforms depicting a count-down pulse and a count-up pulse to the counter 212 and FIG. 10G is a signal waveform showing a content of the counter 212. The counter 212 counts up $T_0=0.44$ sec. later from a time instant when the copy arrives at the detecting switch 52 of the collator 2 side, and counts down when an output of the oscillator 194 is generated, i.e., $\tau=6.3$ sec. later after said counting-up timing. Since this count down signal is delayed each time by $\Delta T=0.3$ sec. this signal is delayed by $(20-1)\times 0.3=5.7$ sec. in case of collating, for example, twenty sheets of copies. In order to detect the end of collation for the copies of a certain manuscript, the delayed retention signal is monitored. The copy which is detected after the delayed retention signal has been changed from H level to L level is recognized to the copy belonging to said manuscript and the copy after that is determined to be the copy of the next manuscript. FF 206 is set when the delayed retention signal becomes L level. The content of the counter 212 is counted down into "0" when the collation of copies of a certain manuscript is finished at such a timing that the last copy of a certain manuscript is supplied into a desired bin, and the belt is returned to the home position at the timing mentioned above.

Figure 11:
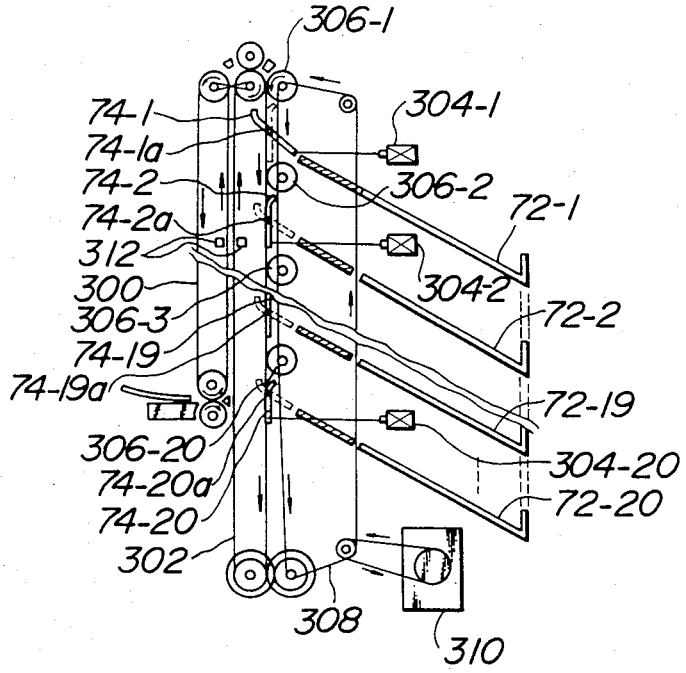
FIG. 11 is a schematic diagram illustrating one embodiment of the collator of solenoid driving type according to the invention.

FIG. 11 is a schematic diagram illustrating another embodiment of the collator according to the invention, wherein the driving control is performed by driving independently the deflectors of respective bins by different solenoids. The copy supplied from the main body of the copying machine 1 (see FIG. 1) is travelled upward being clamped between a pair of travelling belts 300 and 302, and then travelled downward by changing a travelling direction at an uppermost position. The deflectors 74-1 to 74-20 are rotatably arranged about the shafts 74-1*a* to 74-20*a* at an inlet of respective bins 72-1 to 72-20, and each plunger of the solenoids 304-1 to 304-20 is journalled to respective deflectors. Moreover, feeding rollers 306-1 to 306-20 are arranged at an inlet of respective bins 74-1 to 74-20 and driven to rotate by a belt 308 and a motor 310. When the first copy of a certain manuscript is supplied, the deflector 74-1 is rotated by driving the solenoid 304-1 as shown in FIG. 11 and is intruded into the copy travelling path. The copy travelled downward between the travelling belt 302 and the feeding roller 306 is changed in its direction by being made in contact with the deflector 74-1 and is supplied into the uppermost bin 72-1.

In this embodiment, the solenoids 304-1 to 304-20 are driven by two independent controlling circuits and it is possible to drive solenoids at different positions at the same time, so that during the collation of the copy of a certain manuscript it is possible to start the collation of the copy of the next manuscript. Further, at an upstream position with respect to the first bin 72-1 in the copy travelling path is arranged a copy detecting switch 312 for detecting the copy supplied from the copying machine to the collator. In this embodiment, copy travelling speed, bin pitch, and relation of the position between the first bin 72-1 and the copy detecting switch 312 in the collator are the same as the embodiment described above.

Figure 12:
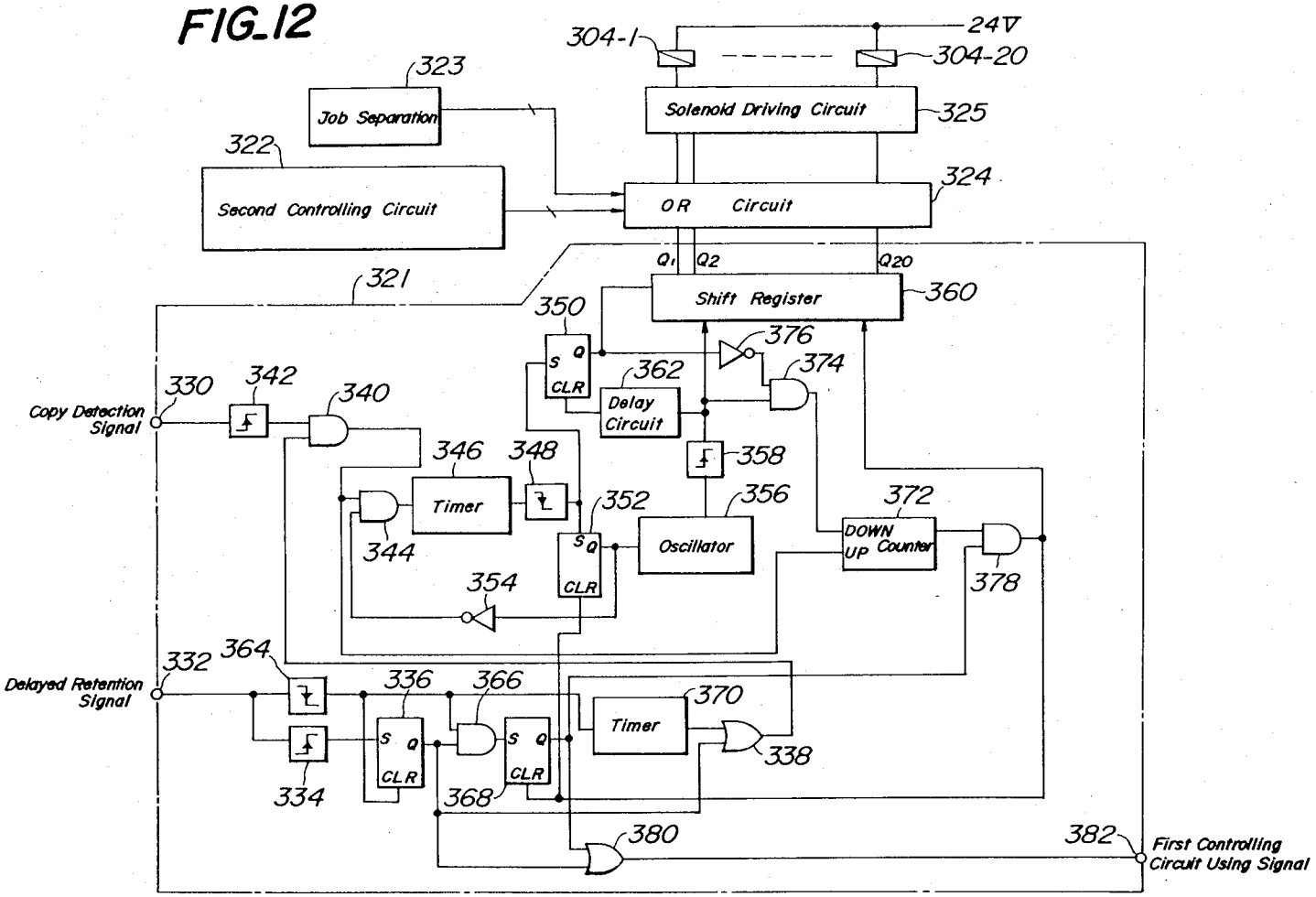
FIG. 12 is a circuit diagram depicting one embodiment of a main part of the collator controlling unit shown in FIG. 11.

FIG. 12 is a circuit diagram illustrating a main part of the controlling unit for the collator shown in FIG. 11. This embodiment comprises the first controlling circuit 321 and the second controlling circuit 322 which are controlled to drive the solenoids 304-1 to 304-20 mutually in an independent manner, and further comprises a job separation controlling circuit 323 in which a plurality of copies of a certain manuscript are delivered into a certain bin and a plurality of copies of a next manuscript are delivered into next bin and so on. A switching circuit for these three controlling circuits is omitted in this embodiment, but the switching circuit (FIG. 9) in the embodiment described above in which two belts are used can be applied for the first and the second controlling circuits 321 and 322 also in this embodiment. Since a construction of the first controlling circuit 321 can be the same as that of the second controlling circuit 322, only a detailed circuit construction of the first controlling circuit 321 is shown in FIG. 12. Output signals of the first controlling circuits 321 and job separation controlling circuit 323 are supplied to OR circuit 324 and then the solenoids 304-1 to 304-20 are driven by means of a solenoid driving circuit 325 on the basis of these output signals.

Figures 13A, 13B, 13C, 13D, 13E, 13F, 13G, 13H, 13I, 13J, 13K, 13L, 13M, 13N, 13O, 13P, 13Q:
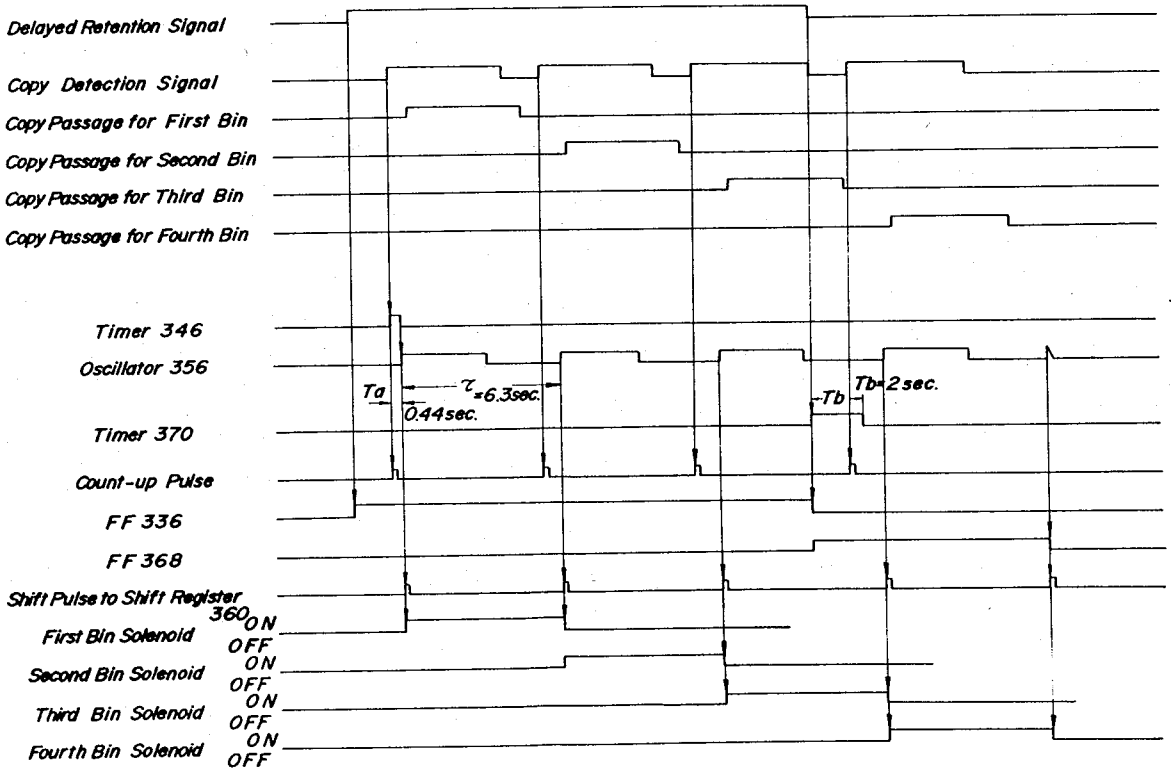
FIGS. 13A to 13Q are signal waveforms explaining an operation of the controlling circuit shown in FIG. 12.

Now, a construction and an operation of the first controlling circuit 321 shown in FIG. 12 will be explained with reference to signal waveforms illustrated in FIGS. 13A to 13Q showing various timings in case of collating four sheets of copies of respective manuscripts.

A copy detection signal from the copy detecting switch 312 arranged in the copy travelling path of the collator side is supplied to an input terminal 330. As shown in FIG. 13B, this copy detection signal becomes H level during an interval in which the copy passes through the switch 312. The delayed retention signal shown in FIG. 13A supplied from the switching circuit similar to that illustrated in FIG. 9 is supplied to an input terminal 332.

After the duplication is started and the delayed retention signal is supplied, a pulse is generated from a pulse circuit 334 at the raising edge of the delayed retention signal so as to set FF 306 as shown in FIG. 13K. Q output of FF 336 is supplied to AND gate 340 through OR gate 338 to enable the AND gate 340, so that a timer 346 is set through AND gate 344 by a raising edge of a pulse supplied from a pulse circuit 342 at a raising edge of the copy detection signal. This timer 346 is constructed to generate a pulse of H level shown in FIG. 13G for a time interval which is equal to a time period required for the copy to travel from the copy detecting switch 312 to a copy inlet of the first bin 72-1 substracted a bin interval $\Delta T=0.3$ sec. This time interval Ta of 0.44 sec. is the same as $T_o$ in the embodiment described above. A pulse is generated by a pulse circuit 348 at a trailing edge of the pulse of the timer 346, so that FFs 350 and 352 are set by the pulse from the pulse circuit 348. Q output of FF 352 is inverted by an inverter 354 and is supplied to AND gate 344, so that any copy detection signal produced by successive copies of the same manuscript is prevented from passing through the AND gate 344. Also, this Q output is supplied to an oscillator 356. A pulse is produced by a pulse circuit 358 as shown in FIG. 13M at a raising edge of a pulse generated from the oscillator 356 at a period of $\tau=6.3$ sec. as illustrated in FIG. 13H, and is supplied to a clock input terminal of a shift register 360. Since FF 350 has been set and its Q output has been H level, data "1" is supplied to the shift register 360. Moreover, since the FF 350 is reset a few $\mu$ sec. later through a delay circuit 362 by the pulse supplied from the pulse circuit 358, Q output of this FF 350 changes from H level to L level. Then, each time the clock pulse is supplied from the pulse circuit 358 to the shift register 360, the read-in data "1" is shifted one by one in the shift register 360. Further, since the clock pulse supplied from the pulse circuit 358 is generated at a rate of 6.3 sec. of the operation period of oscillator 356 as shown in FIG. 13M, the data is shifted at a rate of 6.3 sec. If the signals having H level are supplied successively from $Q_1$ to $Q_4$ outputs of the shift register 360, the solenoids 304-1 to 304-4 are driven successively through OR gate 324 and the solenoid driving circuit 325 as shown in FIGS. 13N to 13Q, so that four sheets of copies of the same manuscript are delivered into the bins 72-1 to 72-4 successively. Further, timings of copy passage at respective copy inlets of the first bin 72-1 to the fourth bin 72-4 are shown in FIGS. 13C to 13F. However, since each of solenoids is energized for a time interval longer than that during which the copy passes through the bin inlet, respective copies are completely delivered into successive bins.

When the delayed retention signal changes from H level to L level, a pulse is generated from a pulse circuit 364 at a trailing edge of the delayed retention signal, so that FF 336 is reset and FF 368 is set through AND gate 366 as shown in FIG. 13L simultaneously. At the same time, a timer 370 is set by the pulse generated from the pulse circuit 364. Since this timer 370 generates a signal of H level for an interval Tb=2 sec. as shown in FIG. 13I, AND gate 340 is enabled for an interval Tb through OR gate 338 by the signal mentioned above, so that one sheet of the copy travelled after the delayed retention signal changes to L level is recognized to be the last copy of the previous manuscript. An output of AND gate 340 is supplied to a count-up terminal of a counter 372 at a timing shown in FIG. 13J.

An output of the oscillator 356 is supplied to the shift register 360 through the pulse circuit 358 and at the same time is supplied to a count-down terminal of the counter 372 through AND gate 374. However, a first pulse generated from the oscillator 356 is not supplied to the counter 372, because at this time FF 350 has been set and Q output of FF 350 has been supplied to AND gate 374 through an inverter 376 and the AND gate 374 has been disabled. In this manner, the content of counter 372 is counted up at the arrival of the copy and counted down every time a content of the shift register is shifted by a clock pulse from the pulse circuit 358.

When the content of counter 372 is counted down to "0" after the completion of copying operation for a certain manuscript, FF 368 is set at this time, so that the shift resister 360, FF 352, FF 368 are reset by an output of AND gate 378 and the controlling operation is ended. Further, Q outputs of FF 336 and FF 368 are supplied to an output terminal 382 through OR gate 380 and is also supplied to a switching circuit not shown as a first controlling circuit using signal.

Figure 14:
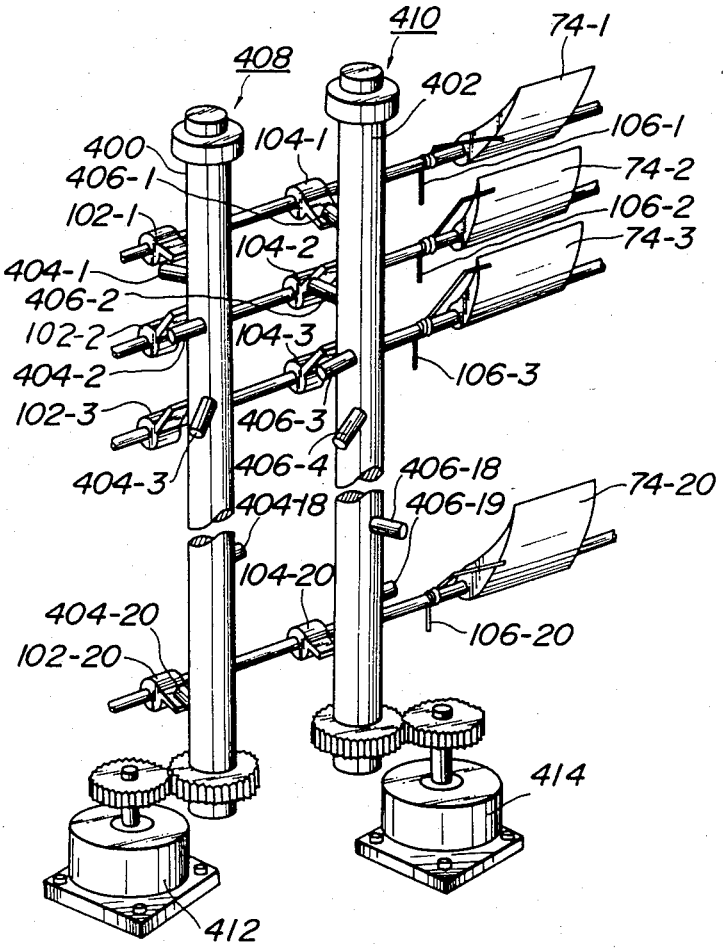
FIG. 14 is a perspective view illustrating one embodiment of the collator of cam shaft driving type according to the invention.

In the above explained embodiments of the collator according to the invention, the two endless belts and a group of solenoids are controlled independently by the two independent controlling circuits. FIG. 14 shows still another embodiment of the collator according to the invention. In this embodiment along the copy travelling direction are arranged in parallel with each other two cam shafts 408 and 410 to which cam chips 404-1 to 404-20 and 406-1 to 406-20 are mounted at almost the same interval around surfaces of movable shafts 400 and 402 so as to drive deflectors 74-1 to 74-20 for respective bins. These cam shafts 408 and 410 are controlled to be driven independently by means of motors 412 and 414 controlled by the controlling unit explained in FIGS. 6 to 9. Further, in this case, a pitch signal can be derived by a microswitch or an encoder.

The invention is not limited to the above described embodiments, but various modifications and alternations are possible. For example, in the embodiment shown in FIG. 2 the projection-like moving chip is provided on the endless belt, but it is possible to construct the deflector actuating portion by forming a concave portion or an aperture in the belt. In addition, it is possible to use a combination of the endless belt shown in FIG. 2 and the cam shaft illustrated in FIG. 14. Further, the collator can be so constructed that at least two deflectors travelling along copy inlets of respective bins are arranged independently and are controlled by independent sequences.

As explained above in detail, in the collator according to the invention, at least two deflectors for delivering the copies travelling successively along the copy travelling path into successive bins are operated at two different bin positions at the same time and thus, the collator can be advantageously used in combination with the retention type copying machine which can supply copies at a fast rate and the collation can be performed effectively.

What is claimed is:

1. A collator for use in combination with an apparatus such as a copying machine, a printing machine, and the like, for delivering a plurality of copies successively, said collator comprising: a plurality of bins arranged in parallel with each other along a copy travelling path; means for feeding the copies along the copy travelling path; means for delivering the copies fed successively along the copy travelling path into successive bins; and means for simultaneously driving selected ones of said delivering means so as to effect copy delivery simultaneously to at least two different bin positions, whereby during a copy delivering operation for a plurality of copies of a certain manuscript, it is possible to initiate the copy delivering operation for a plurality of copies of the next manuscript.

2. A collator according to claim 1, wherein said delivering means comprises a plurality of claw-like deflectors each of which is movably arranged at respective bin inlets to intrude into the copy travelling path, and said driving means comprises at least two deflector driving members for intruding said deflectors successively into the copy travelling path and a controlling unit for controlling said deflector driving members in a mutually independent manner.

3. A collator according to claim 2, wherein each of said deflector driving members comprises an endless belt having an actuator portion which cooperates with the claw-like deflectors.

4. A collator according to claim 3, wherein said actuator portion of said endless belt is formed by a projection which can engage with successive driving members connected to said deflectors.

5. A collator according to claim 4, wherein each of said driving member comprises a claw-like chip secured to a shaft to which said deflector is also secured.

6. A collator according to any one of claims 3, 4 and 5, wherein two endless belts are rotatably arranged in parallel with each other along said copy travelling path.

7. A collator according to claim 2, wherein said deflector driving members comprises two rotating cam shafts extending in parallel with each other along said copy travelling path and each having a plurality of cam chips for driving said defelctors.

8. A collator according to claim 7, wherein said cam chips are arranged at a constant interval around said rotating cam shaft spirally.

9. A collator according to any one of claims 7 and 8, wherein said driving means comprises two driving motors coupled with said cam shafts, respectively and said controlling unit comprises two separate circuits for energizing said driving motors independently.

10. A collator according to claim 1, wherein said delivering means comprises a plurality of solenoids and a plurality of claw-like deflectors each of which is movably arranged at an inlet of respective bins to be driven by respective ones of said solenoids to intrude into said copy travelling path, and said driving means comprises at least two independent controlling circuits for energizing at least two solenoids simultaneously.

11. A collator for use in combination with an apparatus such as a copying machine, a printing machine, and the like, for delivering a plurality of copies successively, said collator comprising: a plurality of bins arranged in parallel with each other along a copy travelling path; means for feeding the copies along the copy travelling path; means for delivering the copies fed successively along the copy travelling path into successive bins, said delivering means including a plurality of claw-like deflectors each of which is movably arranged at respective bin inlets to intrude into the copy travelling path; and means for driving of said delivering means so as to effect copy delivery simultaneously to at least two different bin positions, whereby during a copy delivering operation for a plurality of copies of a certain manuscript, it is possible to initiate the copy delivering operation for a plurality of copies of the next manuscript, said driving means including at least two deflector driving members for intruding said deflectors successively into the copy travelling path and a controlling unit for controlling said deflector driving members in a mutually independent manner, said driving means further including two endless belts and a single driving motor and two electromagnetic clutches coupled between the driving motor and said two endless belts, respectively, and said controlling unit comprises two separate circuits for energizing independently said clutches, respectively.

* * * * *